US009747878B1

(12) United States Patent
Atakhanian

(10) Patent No.: US 9,747,878 B1
(45) Date of Patent: Aug. 29, 2017

(54) SYSTEM, METHOD AND COMPUTER PROGRAM PRODUCT FOR GENERATING MUSICAL NOTES VIA A USER INTERFACE TOUCH PAD

(71) Applicant: Yourik Atakhanian, Hillsdale, NJ (US)

(72) Inventor: Yourik Atakhanian, Hillsdale, NJ (US)

( * ) Notice: Subject to any disclaimer, the term of this patent is extended or adjusted under 35 U.S.C. 154(b) by 0 days.

(21) Appl. No.: 15/227,220

(22) Filed: Aug. 3, 2016

Related U.S. Application Data

(63) Continuation-in-part of application No. 13/568,024, filed on Aug. 6, 2012, now abandoned.

(60) Provisional application No. 61/515,564, filed on Aug. 5, 2011.

(51) Int. Cl.

| | |
|---|---|
| ***G10H 1/36*** | (2006.01) |
| ***G10H 1/18*** | (2006.01) |
| ***G10H 3/14*** | (2006.01) |
| ***G10H 1/00*** | (2006.01) |
| ***G10H 1/34*** | (2006.01) |

(52) U.S. Cl.
CPC ..... *G10H 1/183* (2013.01); *G10H 1/0066* (2013.01); *G10H 1/344* (2013.01); *G10H 3/146* (2013.01); *G10H 2220/096* (2013.01); *G10H 2240/285* (2013.01)

(58) Field of Classification Search
CPC ..... G10H 1/0066; G10H 1/00; G10H 1/0058; G10H 2240/056; G10H 2240/311; G10H 2220/525; G10H 1/40; G10H 2210/071; G10G 1/00
See application file for complete search history.

(56) References Cited

U.S. PATENT DOCUMENTS

2009/0301289 A1* 12/2009 Gynes ..... G10H 1/0066 84/645
2010/0300264 A1* 12/2010 Foster ..... G10H 1/0058 84/610
2010/0300269 A1* 12/2010 Applewhite ..... G10H 1/0058 84/610
2010/0300270 A1* 12/2010 Applewhite ..... G10H 1/0058 84/610
2010/0304863 A1* 12/2010 Applewhite ..... G10H 1/368 463/36

* cited by examiner

*Primary Examiner* — Marlon Fletcher
(74) *Attorney, Agent, or Firm* — Ashkan Najafi

(57) ABSTRACT

A music generating system enables a user to generate independent and sequential musical melodies, having reduced latency periods, without playing an electronic percussion instrument. The music generating system includes an electronic percussion instrument, a MIDI controller coupled to the electronic percussion instrument, a unidirectional USB communication link coupled to the MIDI controller, a MIDI converter coupled to the unidirectional USB communication link, a bidirectional USB-MIDI communication link coupled to the MIDI converter, and a rhythm drum machine in communication with the bidirectional USB-MIDI communication link. The MIDI converter is configured to independently and sequentially receive and learn a first audio control signal and a second audio control signal in a non-overlapping pattern, and thereby independently and sequentially generates and transmits to the rhythm drum machine a first musical melody and a second musical melody corresponding to the first audio control signal and the second audio control signal, respectively.

14 Claims, 13 Drawing Sheets

SYSTEM, METHOD AND COMPUTER PROGRAM PRODUCT FOR GENERATING MUSICAL NOTES VIA A USER INTERFACE TOUCH PAD

CROSS REFERENCE TO RELATED APPLICATIONS

This is a continuation-in-part application of currently pending U.S. patent application Ser. No. 13/568,024, filed Aug. 6, 2012, which claims the benefit of U.S. Provisional Application No. 61/515,564, filed Aug. 5, 2011, the entire disclosures are incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF NON-LIMITING EXEMPLARY EMBODIMENT(S) OF THE PRESENT DISCLOSURE

Technical Field

This disclosure relates to portable musical note generating systems, methods and computer software programs and, more particularly, to a musical note generating system, method and computer software program for assisting a user to simulate musical notes from an instrument without actually playing the instrument.

Prior Art

Known in the art are electronic percussion musical instruments which have music playing manipulation elements in the form of a pad (i.e. playing pads) to be struck by the player and generate electronic musical tones resembling drum sounds and cymbal sounds when the pads are struck, such as disclosed in registered Japanese patent publications No. 3,835,163 and No. 3,554,770. Such electronic percussion instruments having pad-type music playing manipulation elements are capable of generating individual musical tones or a short phrase of musical tones when the pads are struck by the sticks or hands or other body parts.

Such known electronic percussion instruments are provided with a plurality of playing pads, which are usually arranged in close positions to each other. Such an arrangement, however, has a drawback that the player may erroneously strike a wrong pad other than the intended pad in playing the instrument. Especially in the case of a desktop-type electronic percussion instrument in a small size having a plurality of playing pads wherein each of the pads has accordingly a small striking area, there will be a high possibility of striking a wrong pad adjacent to the intended pad.

Further, in a conventional electronic percussion instrument having a plurality of playing pads, the musical tones to be generated in response to the strikes on the pads are set individually pad by pad. The operation of setting the musical tones to the individual pads, however, will be troublesome and time-consuming where there are so many pads, and the work for setting various items during the music playing manipulation will accordingly very troublesome, which will therefore deteriorate the easiness and the convenience of a desktop-type electronic percussion instrument which is designed for the player to enjoy simple plays on the percussion instrument.

Further, the conventional models of electronic percussion instruments are mostly of the type which has striking pads in the form of randomly placed pads, and accordingly the striking operations against the pads are limited to a basic manner of striking the pad face with the tip ends of the beating sticks. On such conventional electronic percussion instruments, the player cannot manipulate the instrument in manners such as to mimic a guitar or a piano. Thus, the conventional models do not meet the need for a wide range of manipulating operations.

Further, the conventional electronic percussion instruments have a plurality of pads which are individually arranged independent from each other, and accordingly require a basic playing manner of handling each of the pads as a separate manipulation zone. Thus, the conventional models are not intended for a wide variety of playing manners by effectively utilizing the plurality of pads, such as by combining plural pads into an enlarged manipulation area to mimic performances on a variety of percussion instruments.

Furthermore, conventional electronic percussion instruments suffer from the disadvantage of the being limited to the number of keys present which decide the number of musical melodies that can be generated with the specific keys, being too complicated for a layman without any knowledge to play music. A direct consequence of this limitation is that the user needs to have proper training and guidance before he/she can play the electronic percussion instrument like a piano or a guitar, which have numerous keys/strings mapped to a particular sound. Another significant disadvantage is the latency period present while using MIDI technology to generate sound. This presents as an undesirable lag in the musical melody which would be quite distinguishable to one who appreciates musical melody.

Accordingly, a need remains for method, system and computer software program for providing a hand-like control surface as a MIDI controller that sends MIDI Messages and enables a user to easily play a guitar or a piano without having to learn cumbersome and tedious finger movements typically required for such devices.

BRIEF SUMMARY OF NON-LIMITING EXEMPLARY EMBODIMENT(S) OF THE PRESENT DISCLOSURE

The present subject matter future develops the technology disclosed in U.S. Pat. No. 7,381,884, filed by the inventor of the present application, and incorporated herein by reference in its entirety.

In view of the foregoing background, it is therefore an object of the non-limiting exemplary embodiment(s) to provide a musical note generating system, method and computer software program for assisting a user to simulate musical notes from an instrument without actually playing the instrument. These and other objects, features, and advantages of the non-limiting exemplary embodiment(s) are provided by a method of utilizing a music generating system for enabling a user to simulate musical notes without playing an electronic percussion instrument. Such a method including the chronological steps of: providing an electronic device; providing and communicatively coupling a musical instrument digital interface(MIDI) controller to the electronic device wherein the MIDI controller includes a user interface formed at the MIDI controller such that the user interface is provided with a plurality of sensors capable of receiving a user input; and providing and communicatively coupling a MIDI converter to the MIDI controller. Such a MIDI converter includes a processor communicatively coupled to the user interface for receiving output signals from the MIDI controller. A memory is communicatively coupled to the processor wherein the memory includes a computer software application that is executed by the processor upon receiving the output signals. An input/output interface is communicatively coupled to the processor.

The method further includes the chronological steps of: providing and communicatively coupling a transducer to the MIDI converter; the computer software application converting the output signals to MIDI messages and thereby enabling the MIDI controller to simulate musical notes without actually playing the electronic percussion instrument; and the transducer receiving and audibly emitting the musical notes.

The present disclosure further includes a music generating system for enabling a user to simulate musical notes without playing an electronic percussion instrument. Such a music generating system includes an electronic device; a musical instrument digital interface(MIDI) controller communicatively coupled to the electronic device wherein the MIDI controller includes a user interface formed at the MIDI controller such that the user interface is provided with a plurality of sensors capable of receiving a user input. A MIDI converter is communicatively coupled to the MIDI controller. The MIDI converter includes a processor communicatively coupled to the user interface for receiving output signals from the MIDI controller, and a memory communicatively coupled to the processor. The memory includes a computer software application that is executed by the processor upon receiving the output signals. An input/output interface is communicatively coupled to the processor. Advantageously, the computer software application converts such output signals to MIDI messages and thereby enables the MIDI controller to simulate musical notes without actually playing the electronic percussion instrument. A transducer is communicatively coupled to the MIDI converter thereby receiving and audibly emitting the musical notes.

In a non-limiting exemplary embodiment, the present disclosure includes one or more user interfaces provided with a number of keys or pads condensed into a small area such as a handprint so that the user can play musical instrument sounds selected from a MIDI and/or software. Such musical instrument play is much simpler for a novice user who does not know how to a play a conventional musical instrument. Those skilled in the art understand it is difficult to play a guitar in a conventional manner (i.e., stroking the strings and holding the frets).

In other words, the present disclosure enables easy user access to the user interface (i.e., keys or pads), which are located within a proximity of the user hand. Such a user interface requires less movement of the user's wrist and/or arm and further requires minimal hand/eye coordination by just taping user fingers on the keys or pads—as opposed to painstakingly strokes/holding the strings/frets. Advantageously, there is minimal time delay (minimum latency) from the time the user strikes the keys or pads until the corresponding sound is generated. Notably, many musical notes are located in close proximity to each other and the user's hands and thereby simplifies the process of generating musical sounds.

In a non-limiting exemplary embodiment, each user interface enables close proximity of musical notes and relieves the need to learn conventional hand-eye coordination for playing musical instruments in a conventional manner. Simplified movement of user fingers/hands enables a unique and new technique to play conventional musical instruments. For example, the user interface can be located into a body of a conventional musical instrument such as guitar and/or hand drum. By taping a user's fingers on the keys or pads, actuation of the user interface mimics beats through the MIDI and/or software. Of course, the user interface can be made for left hand and/or right hand users.

In a non-limiting exemplary embodiment, the present disclosure is retrofitted onto a conventional musical instrument and/or MIDI.

In a non-limiting exemplary embodiment, user interface acts as a trigger pad, which is connected to the MIDI directly and/or through software.

In a non-limiting exemplary embodiment, the user interface is placed on a conventional guitar body.

In a non-limiting exemplary embodiment, a neck portion of a conventional guitar may include a second user interface. Both user interfaces may have indentations so the user knows a position of his/her fingers. Of course, the key or pads may be sensitive to pressure so that a more forceful strike creates a louder sound as compared to a less forceful strike, which creates a quieter sound.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 14:
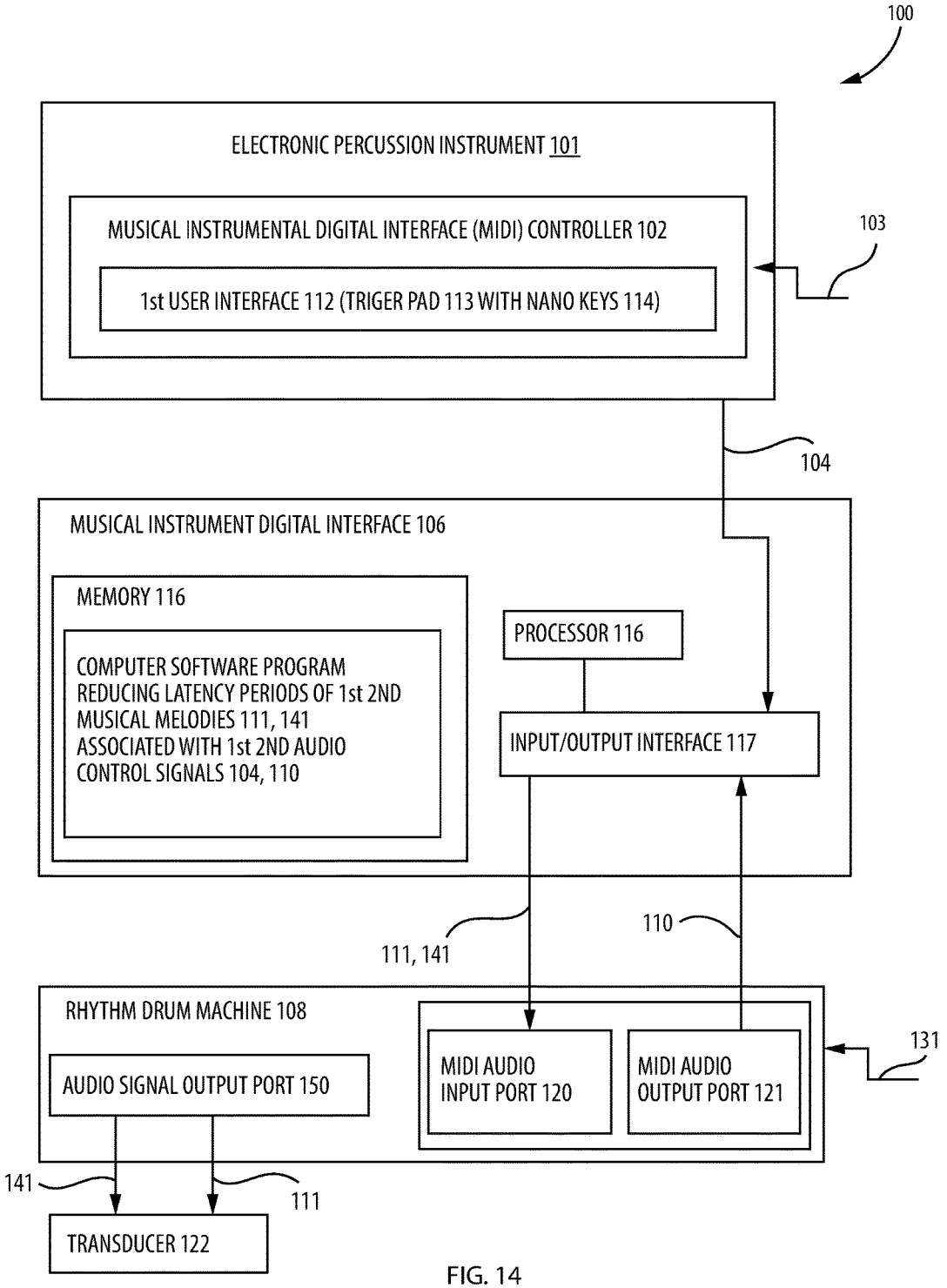
Figure 15:
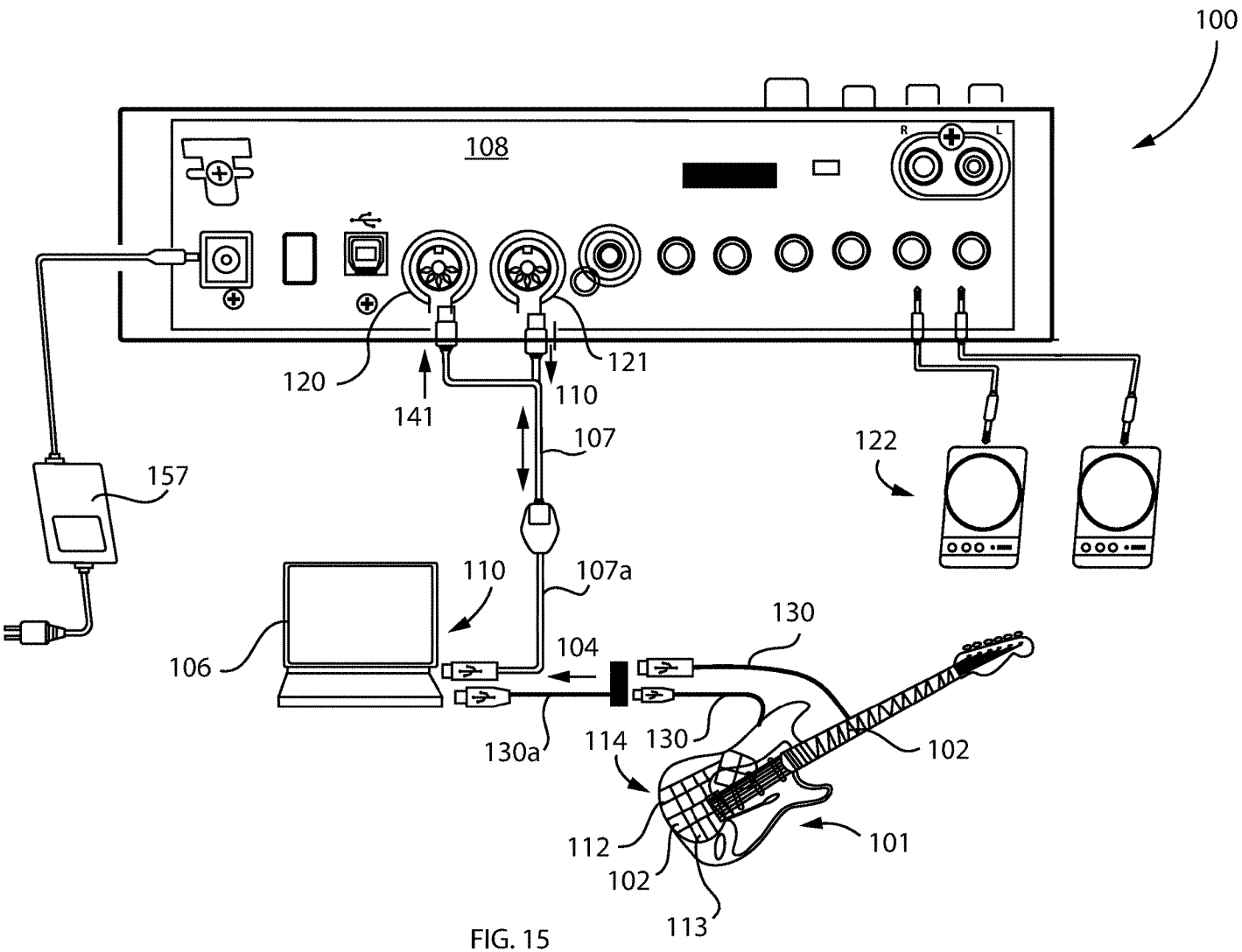

FIG. 14 is a block diagram illustrating the interrelationship between the major electronic components of a music generating system that reduces latency periods associated with independent and sequentially played back musical melodies, in accordance with a non-limiting exemplary embodiment; and FIG. 15 is a schematic diagram illustrating the interrelationship between the major electronic components of the music generating system shown in FIG. 14.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The present subject matter further develops the technology disclosed in U.S. Pat. No. 7,381,884, filed by the inventor of the present application, and incorporated herein by reference in its entirety.

The terms "musical interface data instrument" and "musical instrument digital interface" are interchangeably used throughout the present disclosure. Both are referred to as a MIDI.

The present disclosure will now be described more fully hereinafter with reference to the accompanying drawings, in which preferred embodiment(s) of the disclosure are shown. This disclosure may, however, be embodied in many different forms and should not be construed as limited to the embodiment set forth herein. Rather, this embodiment is provided so that this application will be thorough and complete, and will fully convey the true scope of the disclosure to those skilled in the art.

Referring generally to FIGS. 1-13, a music generating system 10 enables a user to simulate musical notes without playing an electronic percussion instrument. A musical note generating system, method and computer software program assists a user to simulate musical notes from an instrument without actually playing the instrument.

The present disclosure includes a method of utilizing a music generating system for enabling a user to simulate musical notes without playing an electronic percussion instrument is disclosed. Such a method includes the chronological steps of: providing an electronic device 31; providing and communicatively coupling a musical instrument digital interface(MIDI) controller 11 to the electronic device 31 wherein the MIDI controller 11 includes a user interface 11 formed at the MIDI controller 11 such that the user interface 11 is provided with a plurality of sensors 12, 14 capable of receiving a user input 76; and providing and communicatively coupling a MIDI convertor 20 to the MIDI controller 11. Such a MIDI convertor 20 includes a processor 33 communicatively coupled to the user interface 11 for receiving output signals from the MIDI controller 11. A memory 35 is communicatively coupled to the processor 33 wherein the memory 35 includes a computer software application that is executed by the processor 33 upon receiving the output signals. An input/output interface 34 is communicatively coupled to the processor 33.

The method further includes the chronological steps of: providing and communicatively coupling a transducer 40 to the MIDI convertor 20; the computer software application converting the output signals to MIDI messages and thereby enabling the MIDI controller 11 to simulate musical notes without actually playing the electronic percussion instrument; and the transducer 40 receiving and audibly emitting the musical notes.

The present disclosure further includes a music generating system for enabling a user to simulate musical notes without playing an electronic percussion instrument. Such a music generating system includes an electronic device 31; a musical instrument digital interface(MIDI) controller 11 communicatively coupled to the electronic device 31 wherein the MIDI controller 11 includes a user interface 11 formed at the MIDI controller 11 such that the user interface 11 is provided with a plurality of sensors 12, 14 capable of receiving a user input 76. A MIDI convertor 20 is communicatively coupled to the MIDI controller 11. The MIDI convertor 20 includes a processor 33 communicatively coupled to the user interface 11 for receiving output signals from the MIDI controller 11, and a memory 35 communicatively coupled to the processor 33. The memory 35 includes a computer software application that is executed by the processor 33 upon receiving the output signals. An input/output interface 34 is communicatively coupled to the processor 33. Advantageously, the computer software application converts such output signals to MIDI messages and thereby enables the MIDI controller 11 to simulate musical notes without actually playing the electronic percussion instrument. A transducer 40 is communicatively coupled to the MIDI convertor 20 thereby receiving and audibly emitting the musical notes.

In a non-limiting exemplary embodiment, the present disclosure includes one or more user interfaces 11 provided with a number of keys or pads 30 condensed into a small area such as a handprint so that the user can play musical instrument sounds selected from a MIDI controller 11 and/or software. Such musical instrument play is much simpler for a novice user who does not know how to a play a conventional musical instrument. Those skilled in the art understand it is difficult to play a guitar in a conventional manner (i.e., stroking the strings and holding the frets).

In other words, the present disclosure enables easy user access to the user interface 11 (i.e., keys or pads 30), which are located within a proximity of the user hand. Such a user interface 11 requires less movement of the user's wrist and/or arm and further requires minimal hand/eye coordination by just taping user fingers on the keys or pads 30—as opposed to painstakingly strokes/holding the strings/frets. Advantageously, there is minimal time delay (minimum latency) from the time the user strikes the keys or pads 30 until the corresponding sound is generated. Notably, many musical notes are located in close proximity to each other and the user's hands and thereby simplifies the process of generating musical sounds.

In a non-limiting exemplary embodiment, each user interface 11 enables close proximity of musical notes and relieves the need to learn conventional hand-eye coordination for playing musical instruments in a conventional manner. Simplified movement of user fingers/hands enables a unique and new technique to play conventional musical instruments. For example, the user interface 11 can be located into a body of a conventional musical instrument such as guitar and/or hand drum. By taping a user's fingers on the keys or pads 30, actuation of the user interface 11 mimics beats through the MIDI and/or software. Of course, the user interface 11 can be made for left hand and/or right hand users.

In a non-limiting exemplary embodiment, the present disclosure is retrofitted onto a conventional musical instrument and/or MIDI convertor 20.

In a non-limiting exemplary embodiment, user interface 11 acts as a trigger pad, which is connected to the MIDI controller 11 directly and/or through software.

In a non-limiting exemplary embodiment, the user interface 11 is placed on a conventional guitar body.

In a non-limiting exemplary embodiment, a neck portion of a conventional guitar may include a second user interface 11. Both user interfaces 11 may have indentations so the user knows a position of his/her fingers. Of course, the key or pads 30 may be sensitive to pressure so that a more forceful strike creates a louder sound as compared to a less forceful strike, which creates a quieter sound.

In a non-limiting exemplary embodiment, the music generating system 10 preferably includes an electronic device 31 (such as a guitar or PC), a musical instrument digital interface(MIDI) controller 11 communicatively coupled to the electronic device 31. Such a MIDI controller 11 preferably includes a user interface 30 formed at the MIDI controller 11 and provided with sensors 12, 14 capable of receiving user inputs. The user inputs are preferably generated via hand-manipulated strokes and taps, for example. Such musical instrument digital interface(MIDI) controller 11 is communicatively coupled to a musical instrument such as a guitar or a personal computer or laptop, for example. The MIDI controller 11 generates output signals based upon characteristics of the user inputs such as strength, length and pattern of the strokes and taps.

A MIDI converter 20 may be communicatively coupled to the MIDI controller 11 and includes a processor 33 communicatively coupled to the user interface for receiving output signals from the MIDI controller 11, and a memory 35 communicatively coupled to the processor 33. The memory 35 includes a computer software application that is executed by the processor 33 upon receiving the output signals, and an input/output interface 34 communicatively coupled to the processor 33. The computer software application preferably converts the output signals to MIDI messages and thereby enables the MIDI controller 11 to simulate musical notes without actually playing the electronic percussion instrument. A transducer 40 may be communicatively coupled to the MIDI converter 20, and thereby receives and emits the musical notes.

Figure 1:
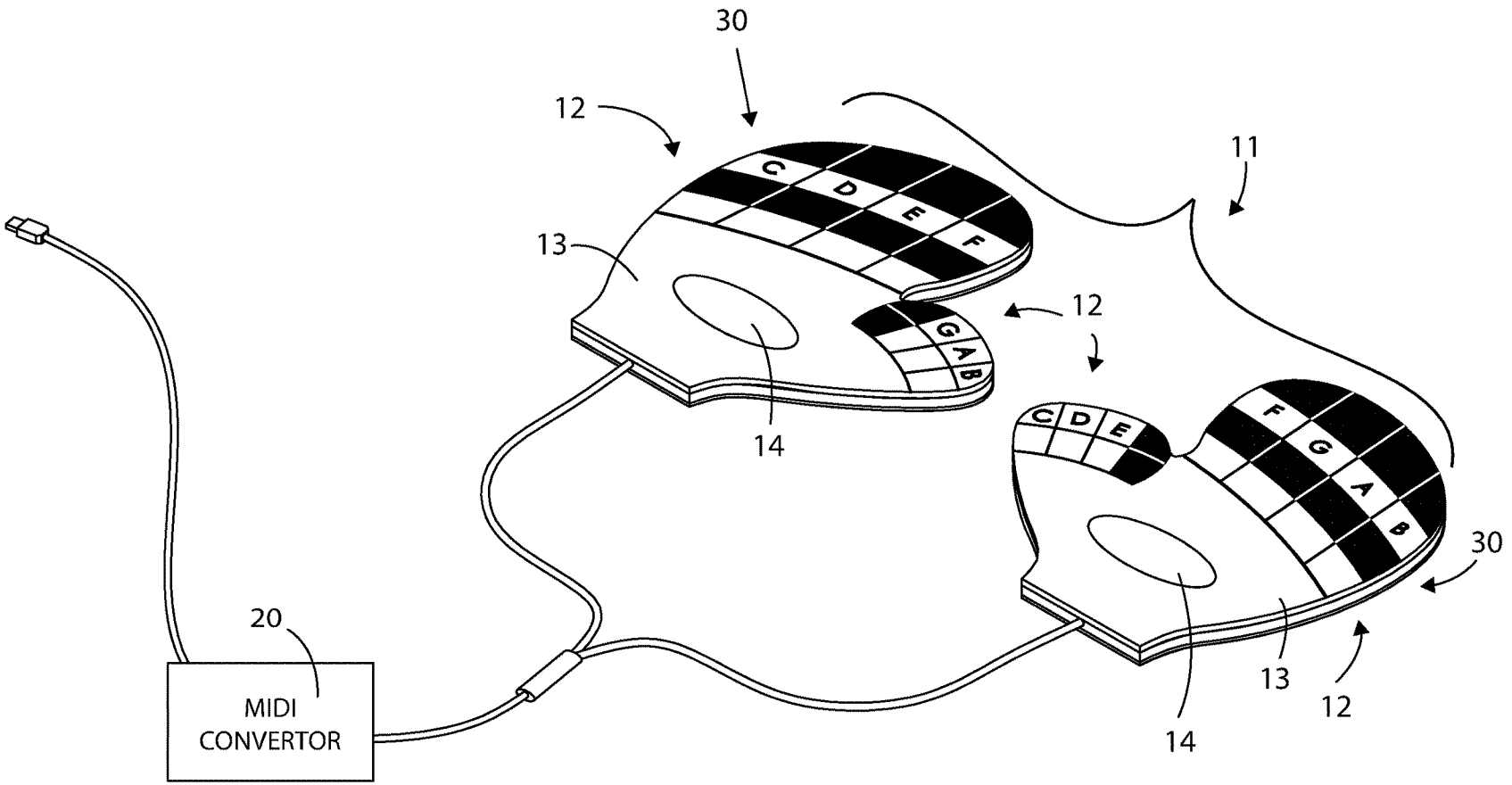
FIG. 1 is a schematic diagram illustrating a hand-like control surface as a MIDI controller that sends MIDI Messages and enables a user to easily play a guitar or a piano without having to learn cumbersome and tedious finger movements typically required for such devices, in accordance with a non-limiting exemplary embodiment.
Figure 2:
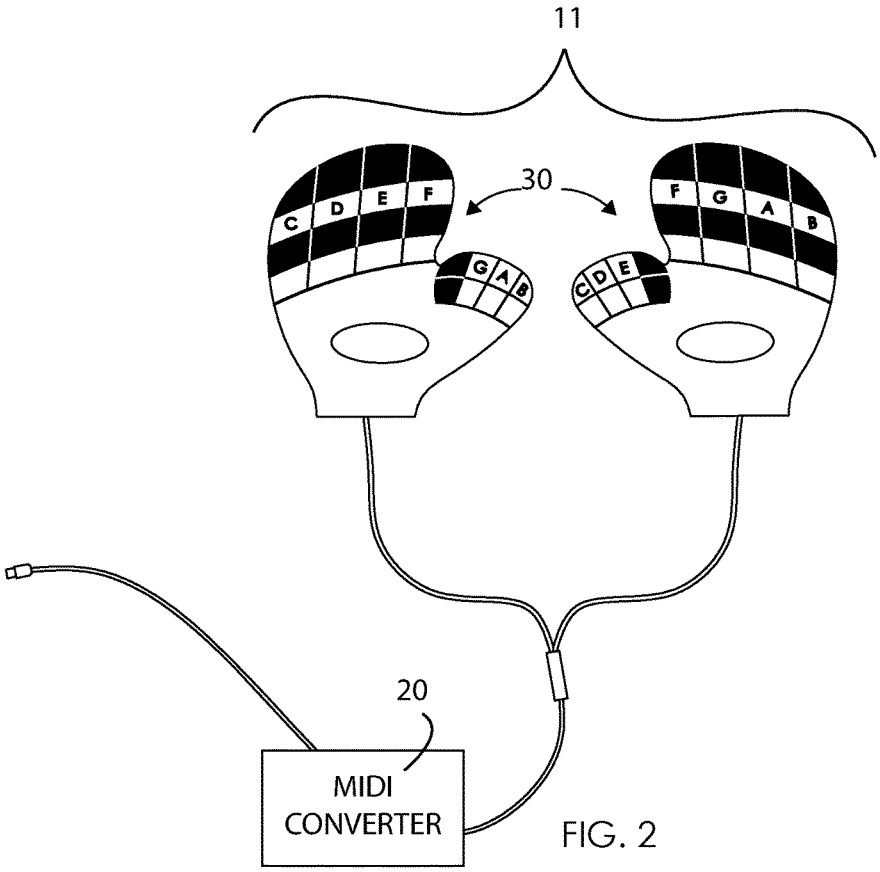
FIG. 2 is a top plan view of the musical note generating system shown in FIG. 1.
Figure 3:
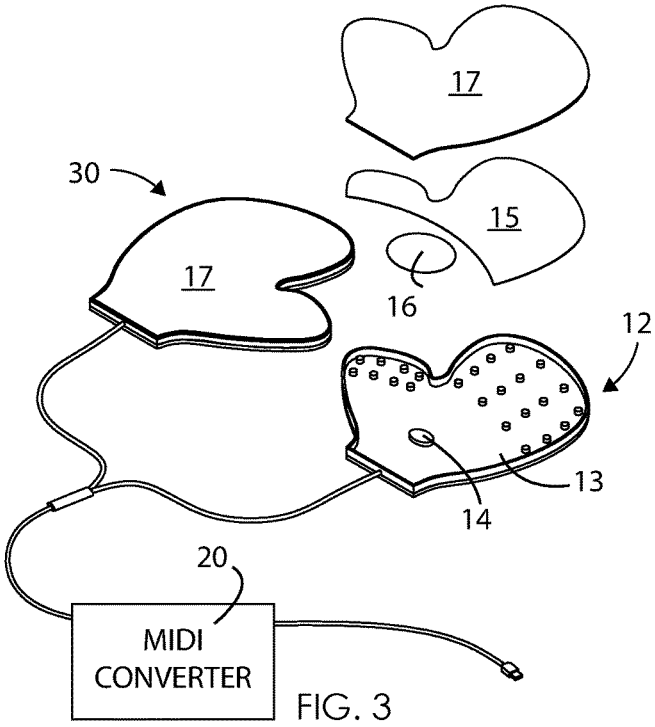
FIG. 3 is an exploded view of the MIDI controller shown in FIG. 1.
Figure 4:
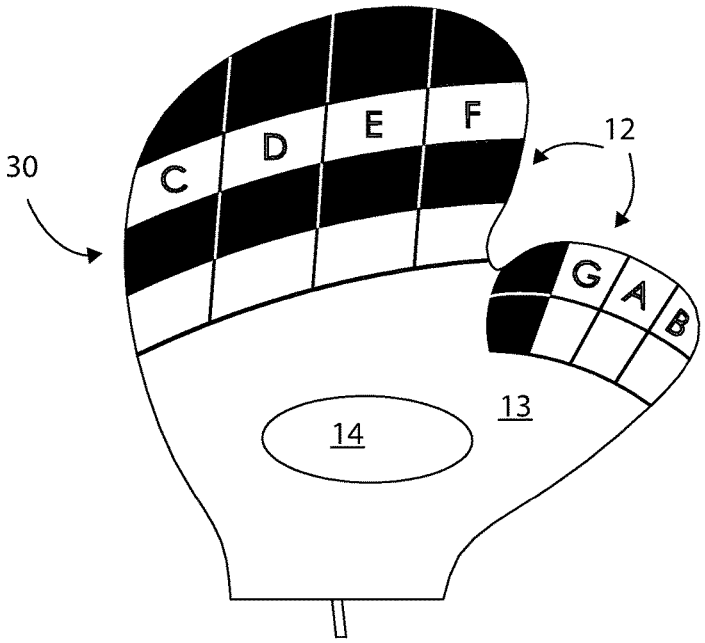
FIG. 4 is a top plan view of a left section of the MIDI controller shown in FIG. 1.
Figure 5:
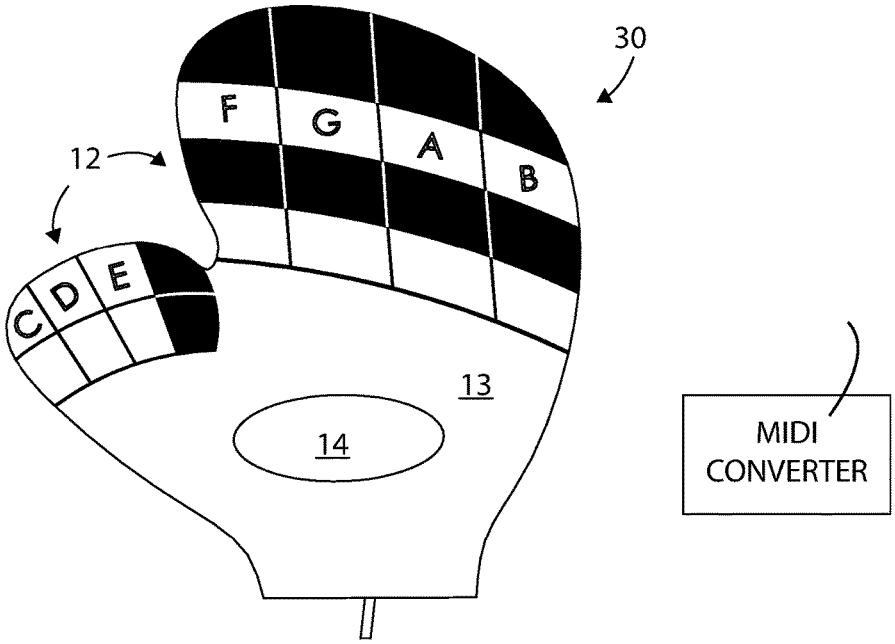
FIG. 5 is a top plan view of a right section of the MIDI controller shown in FIG. 1.
Figure 6:
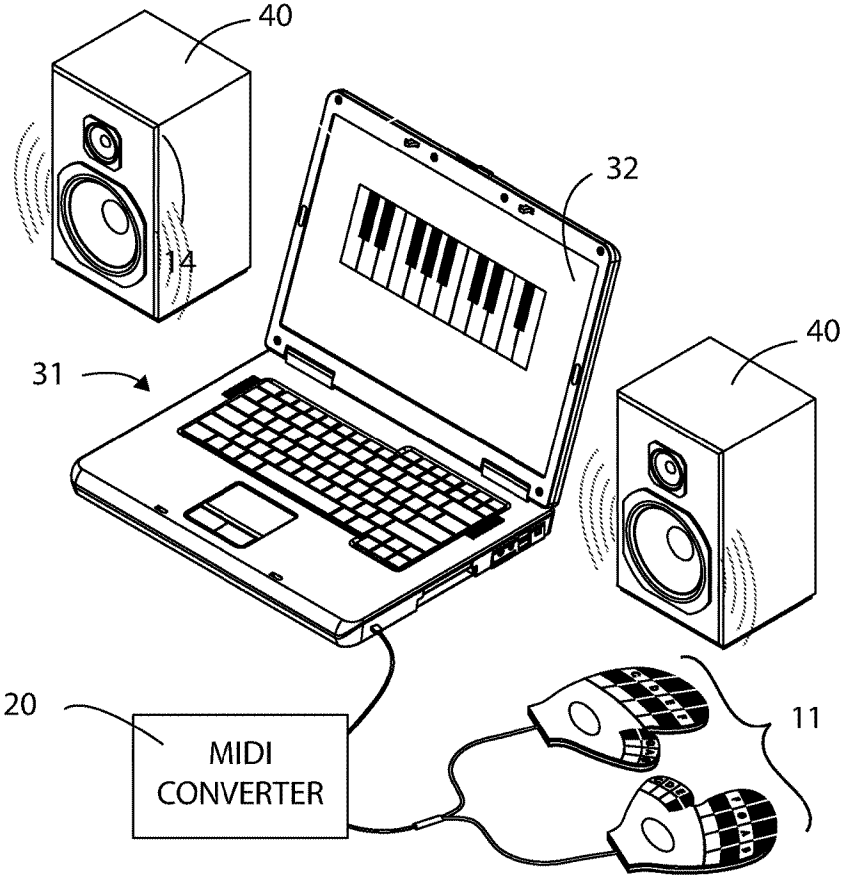
FIG. 6 is a schematic diagram illustrating a musical note generating system for assisting a user to simulate musical notes from an instrument without actually playing the instrument, in accordance with a non-limiting exemplary embodiment.
Figure 7:
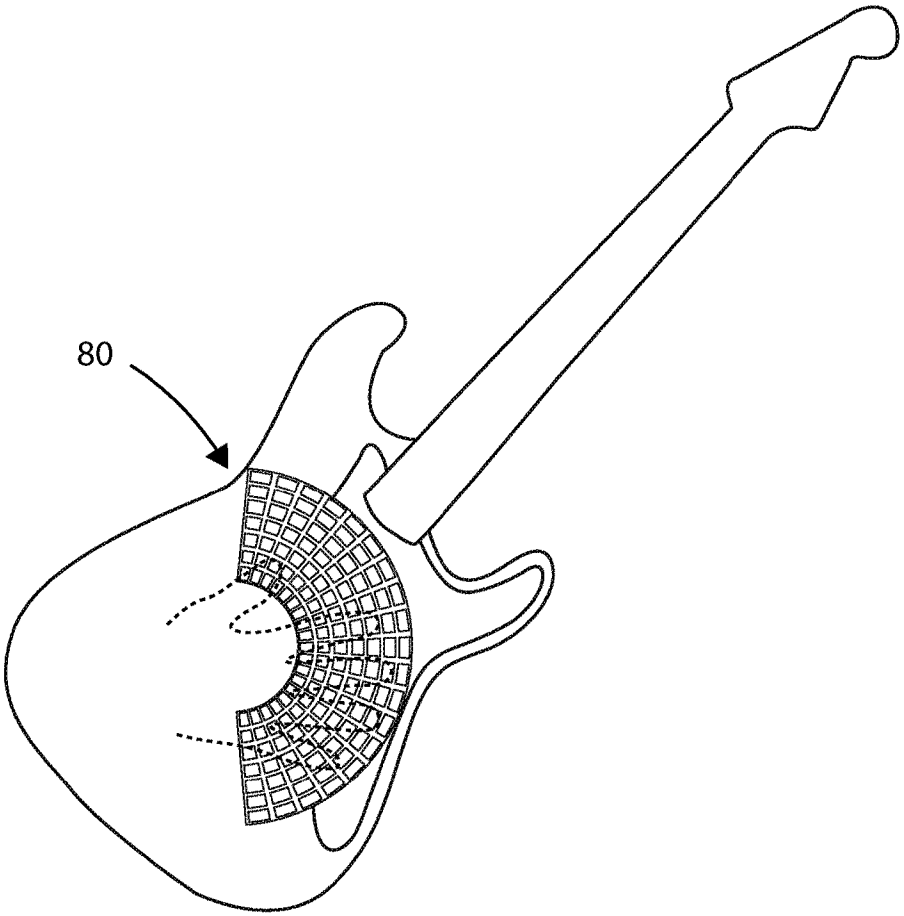
FIG. 7 is a perspective view illustrating a musical note generating system for assisting a user to simulate musical notes from an instrument without actually playing the instrument, in accordance with a non-limiting exemplary embodiment.
Figure 8:
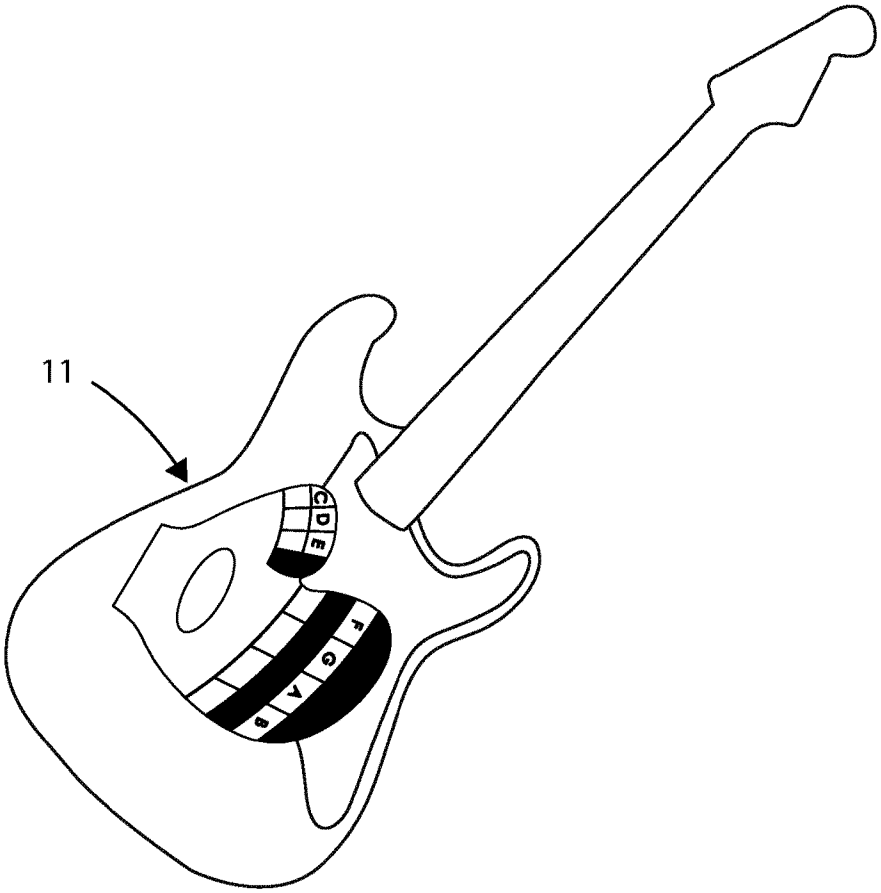
FIG. 8 is a perspective view illustrating a musical note generating system for assisting a user to simulate musical notes from an instrument without actually playing the instrument, in accordance with a non-limiting exemplary embodiment.
Figure 9:
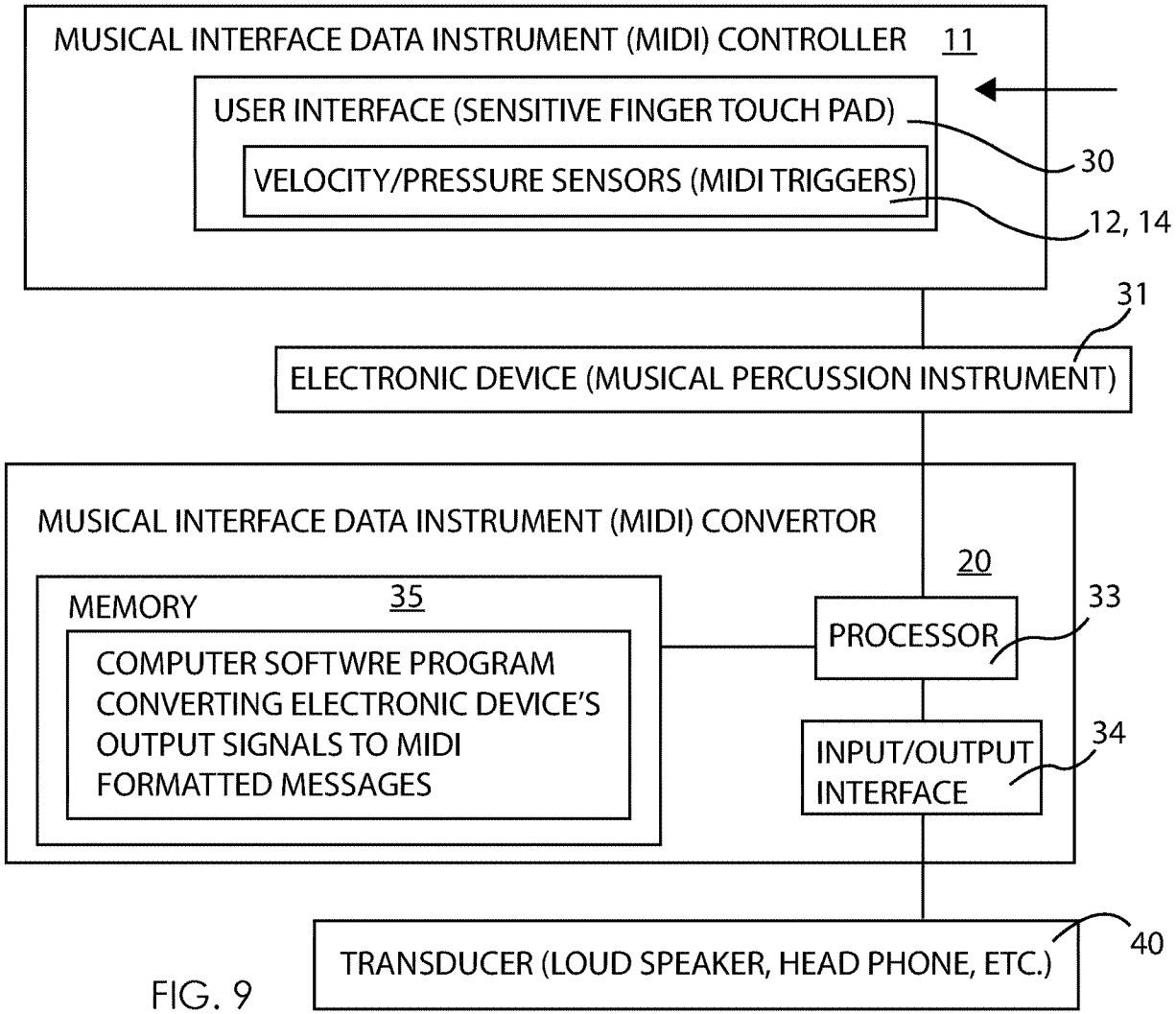
FIG. 9 is a schematic block diagram illustrating a musical note generating system for assisting a user to simulate musical notes from an instrument without actually playing the instrument, in accordance with the embodiments shown in FIGS. 7 and 8.
Figure 10:
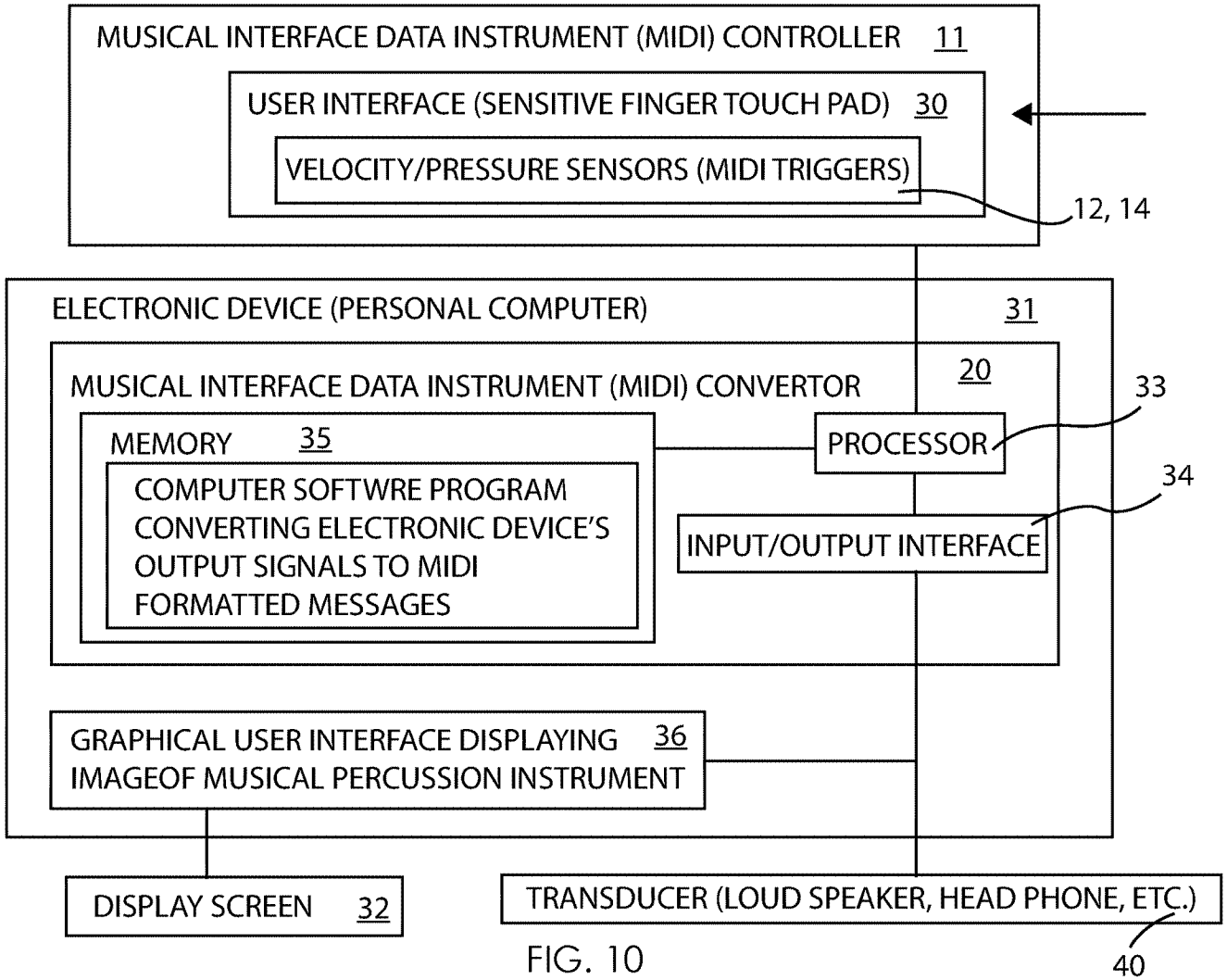
FIG. 10 is a schematic block diagram illustrating a musical note generating system for assisting a user to simulate musical notes from an instrument without actually playing the instrument, in accordance with the non-limiting exemplary embodiment shown in FIG. 9.
Figure 11:
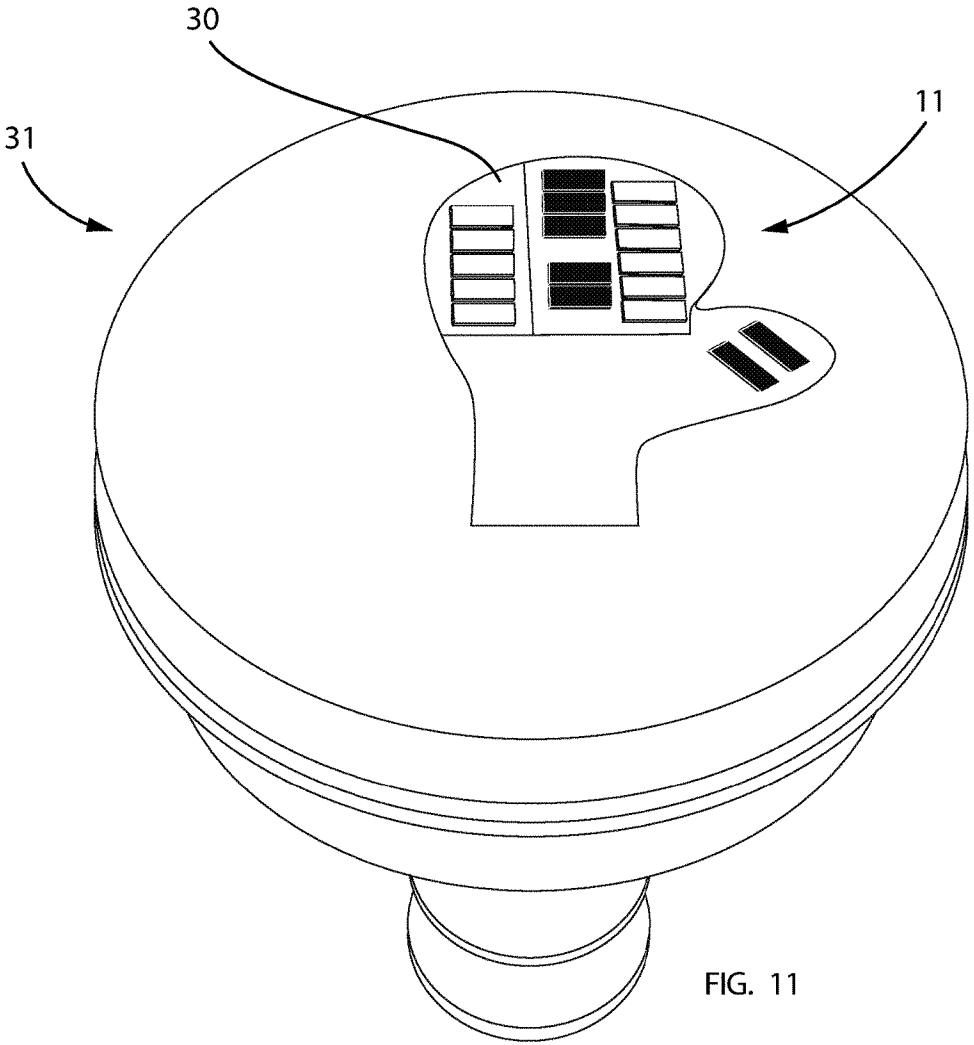
FIG. 11 is a perspective view illustrating a musical note generating system for assisting a user to simulate musical notes from an instrument without actually playing the instrument, in accordance with a non-limiting exemplary embodiment.
Figure 12:
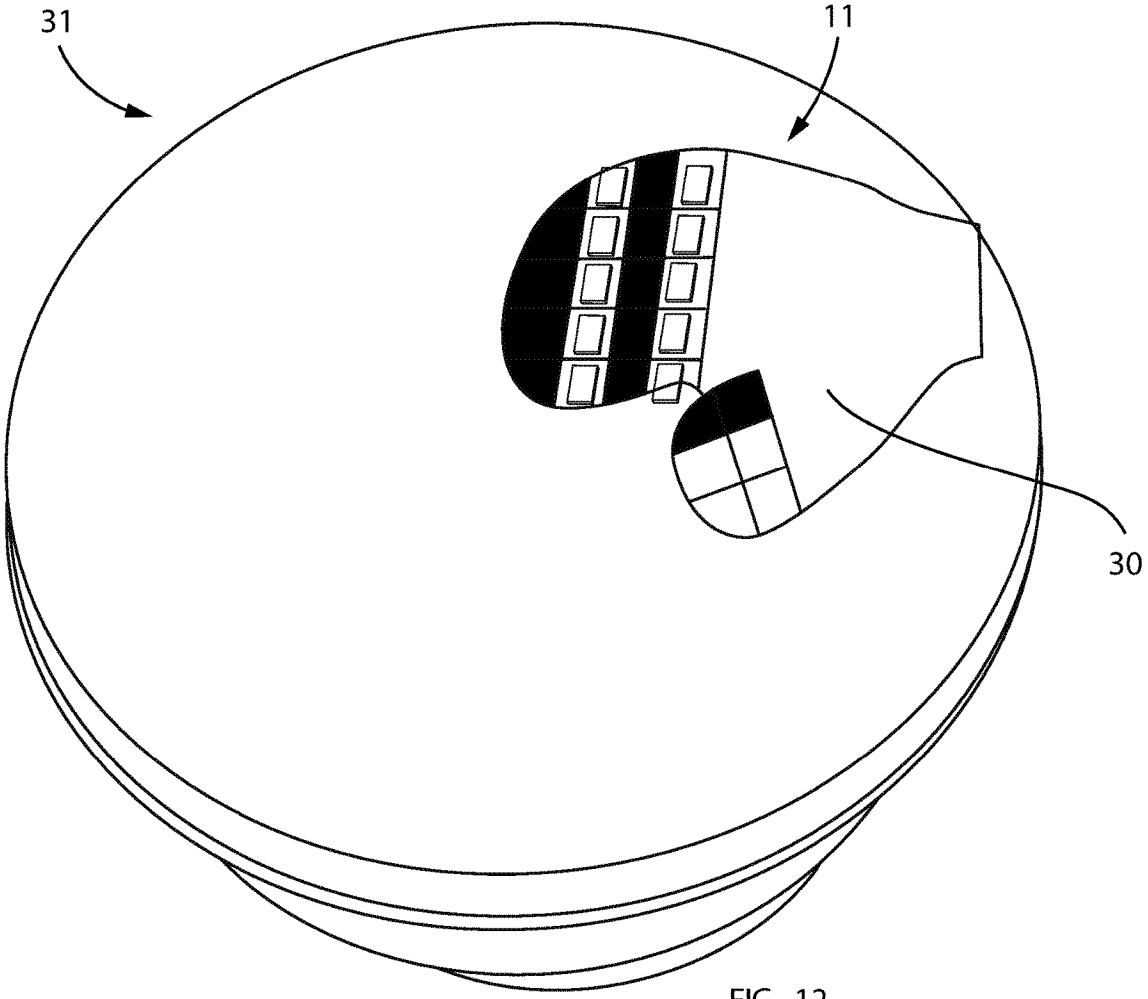
FIG. 12 is a perspective view illustrating a musical note generating system for assisting a user to simulate musical notes from an instrument without actually playing the instrument, in accordance with a non-limiting exemplary embodiment.

FIGS. 7 and 8 illustrate non-limiting exemplary embodiments wherein MIDI controllers 11 and 80 are communicatively coupled to a guitar, for example. The conventional device sold under the brand name DR-880 Dr. Rhythm by BOSS® Corporation may be employed in one or more embodiments of the present disclosure. Such a product may be found at /www.roland.com/products/en/DR-880/. For example, the present disclosure may employ the DR-880 by sending it performance data from an external MIDI device, or play an external MIDI device by operating the DR-880. When used with a guitar, the DR-880 takes the place of conventional guitar strings so the user can generate guitar sounds without needing to flick guitar strings with their fingers in a conventional manner.

The method, system and computer software program of this disclosure 10 is referred to generally in the figures and is intended to provide a hand-enabled control surface at the MIDI controller 11 that sends MIDI messages to the musical instrument or PC, thereby enabling a user to easily play a guitar or a piano without having to learn cumbersome and tedious finger movements typically required for such musical instruments. It should be understood that embodiments of the present disclosure may be used to interface with many different types of musical instruments, PCs and laptops, and should not be limited to any particular electronic device 31 described herein.

Referring to the figures in general, in a non-limiting exemplary embodiment, target zones of the touch pad 30 may be made of a top layer 13 of a resilient material such as rubber. Each target zone may be demarcated by surface indicia provided in the form of a grid or other recognizable pattern. Attached to the under surface of the resilient top layer 13 is provided a plurality of touch sensors 12 aligned with corresponding target zones at the top layer 13. The plurality of touch sensors 12 may be pressure sensitive sensors, for example, which independently detect a pressing operation by the user on to the target zones using fingers, for example. Further, the plurality of touch sensors 12 may be designed to detect the position of the user stroke/tap on the target zones.

To the under surface of the top layer 13 is provided a planar resilient first electro-conductive layer 15 made of conductive material or the like. Each touch sensor 12 is selectively engaged with the first electro-conductive layer 15 therebeneath and creates a closed circuit during strokes/taps, respectively. The top layer 13 of the touch pad 30 may extend along an edge of the first electro-conductive layer 15 and terminates at a bottom layer 17 to define a closed cavity within the touch pad 30. Such a closed cavity houses the first electro-conductive layer 15 as well as the touch sensors 12 and further permits resilient compression/extension of the top layer 13 as the user strokes/taps the target zones on the top layer 13. Such resilient movement permits a feedback force for the user and thereby differentiates a short stroke versus a long stroke along the target zones, translating to short and long audio signal outputs, respectively. Similarly, such resilient movement differentiates a hard, lengthy tap with a soft, short tap along the target zones.

One of the touch sensors 12 may be a control sensor 14 formed in the shape of a planar plate located within the cavity and intercalated between the top layer 13 and bottom layer 17, respectively. A corresponding second electro-conductive layer 16 is positioned beneath the control sensor 14 for separately closing the circuit when control sensor 14 is engaged. In this manner, two separate circuits may be independently closed during playing conditions; control sensor 14 circuit and touch sensor 12 circuit. The control sensor 14 may be made, for example, of a piezoelectric material which can detect the vibration caused by the hit on the top layer 13 and output an electric signal representing the vibration. The second electro-conductive layer 16 may be located within the cavity and disposed adjacent to the first electro-conductive layer 15 and thereby selective engages the control sensor 14 when engaged by a user input. Thus, two output signals may be generated and transmitted to the MIDI converter 20 during playing conditions; short/long output signal and intensity output signal, for example. Such output signals are converted into MIDI messages upon execution by the computer software program at the MIDI converter 20.

In a non-limiting exemplary embodiment, the MIDI converter 20 preferably stores, in a storage device or a ROM, data of musical tones of various timbres (guitar sound, cymbal sound, etc.) for the generation of musical tones in response to the hits on the touch pad 30 during playing conditions. The musical tone data can be coded data as well as sample data which are obtained by sampling actual waveform output signals, for example.

The MIDI converter 20 may be provided with a sampling circuit to obtain sample data from the actual waveforms input thereto via the target zones on the touch pad 30. The MIDI controller 11 may be a stand-along device or physically attached to the electronic instrument thereby simulating a user interface to generate musical notes. For example, the MIDI converter 20 may be electrically coupled between a guitar and a transducer 40 (speaker). Alternately, the MIDI converter 20 may be electrically coupled to a personal computer, which is electrically coupled to a transducer 40 (speaker). Either embodiment permits the user to generate musical output signals that are converted to MIDI messages, without actually playing a musical device, and before being outputted by the transducer 40.

In a non-limiting exemplary embodiment, the MIDI controller 11 may be sized and shaped to match a user's hands. Thus, the touch pad 30 of such a MIDI controller 11 may be configured to simulate a user's metacarpals, palm and a portion of the wrist, for example. Various control functions may be displayed on a graphical user interface 36 shown on a display screen 32 of the personal computer; i.e., display various control buttons including simulated guitar strings, piano keys, drums, etc. The display screen 32 may be a liquid crystal panel 32 provided with indicators for indicating which touch pad 30 target zone is hit by the user, etc. In the vicinity of the MIDI controller 11, there is also arranged the transducer 40 (a sound output device) such as a loudspeaker for outputting the played musical tones and other sounds or voices.

In a non-limiting exemplary embodiment, the display screen 32 may exhibit a screen image for conducting various control setting. For example, piano keys may be displayed and simulated as being stricken when the user hits a corresponding target zone of the touch pad 30. In this manner, the user can visually identify corresponding target zones with guitar strings and/or piano keys, respectively.

In a non-limiting exemplary embodiment, the MIDI converter 20 preferably includes a processor 33 and a memory 35 communicatively coupled thereto. Such a memory 35 is provided with a computer software application that is executed by the processor 33 upon receiving output signals from the MIDI controller 11, for example. The computer software application converts such output signals to MIDI messages and thereby enables the MIDI controller 11 to simulate musical notes without actually playing the musical instrument.

Figure 13:
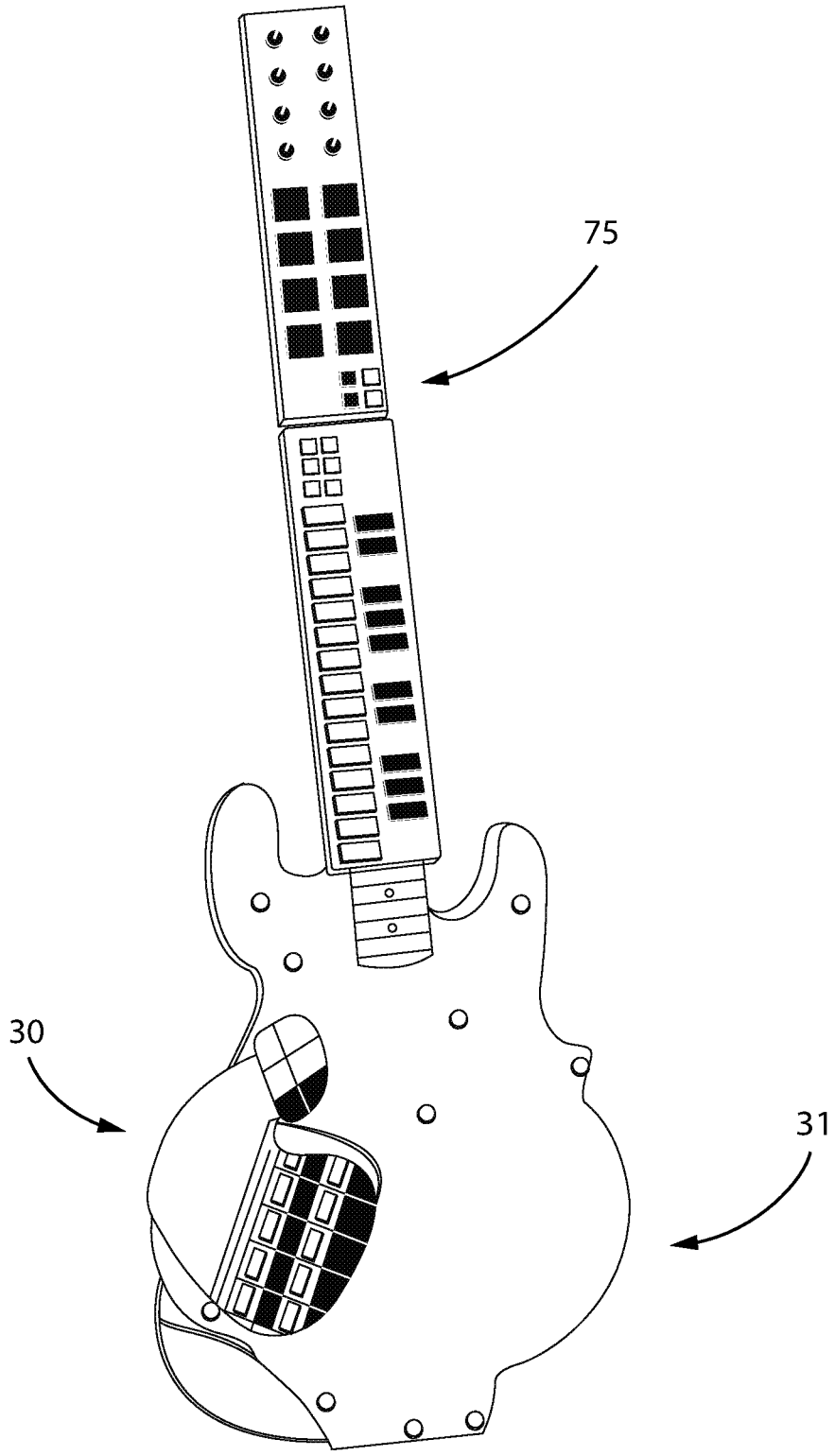
FIG. 13 is a perspective view illustrating a musical note generating system for assisting a user to simulate musical notes from an instrument without actually playing the instrument, in accordance with a non-limiting exemplary embodiment.

FIG. 13 The processor 33 may include a microprocessor or other devices capable of being programmed or configured to perform computations and instruction processing in accordance with the disclosure. Such other devices may include microcontrollers, digital signal processors 33 (DSP), Complex Programmable Logic Device (CPLD), Field Programmable Gate Arrays (FPGA), application-specific integrated circuits (ASIC), discrete gate logic, and/or other integrated circuits, hardware or firmware in lieu of or in addition to a microprocessor.

Functions and process steps described herein may be performed using programmed computer devices and related hardware, peripherals, equipment and networks. When programmed, the computing devices are configured to perform functions and carry out steps in accordance with principles of the disclosure. Such programming may comprise operating systems, computer software applications, software modules, scripts, files, data, digital signal processors (DSP), application-specific integrated circuit (ASIC), discrete gate logic, or other hardware, firmware, or other conventional programmable software.

The memory 35 may include programmable software instructions that are executed by the processor 33. In particular, the programmable software instructions include a plurality of chronological operating steps that define a control logic algorithm for performing the intended functions of the present disclosure. Such software instructions may be written in a variety of computer program languages such as C++, Fortran and Pascal, for example. One skilled in the art understands that such software instructions may contain various Boolean logic processes that perform the intended function of the present disclosure. Therefore, the specific source or object code of the software program is not intended to be a limiting factor in executing the present disclosure's intended function.

The memory 35, which enables storage of data and programs, may include RAM, ROM, flash memory and any other form of readable and writable storage medium known in the art or hereafter developed. The memory 35 may be a separate component or an integral part of another component such as the processor 33.

FIGS. 14-15 illustrate a non-limiting exemplary embodiment including a music generating system 100 that facilitates musical synthesis with reduced latency. Such a music generating system 100 enables a user to generate—via a MIDI controller 102 and/or a rhythm drum machine 108—first and second musical melodies 111, 141 having reduced first and second latency periods 150, 151 associated therewith, respectively. Such musical melodies 111, 141 are produced by activating a MIDI (Musical Instrument Digital Interface) controller 102 including a portable trigger pad 113 having nano keys 114, and/or rhythm drum machine 108, each of which is in communication with a MIDI converter 106 such as a stand-alone electronic device and/or an associated computer software program (i.e., ABLETON® computer software program). The first and second latency periods 150, 151 are time-measured from when a first audio control signal 104 and a second audio control signal 110 are independently and sequentially transmitted, in a non-overlapping pattern, to the MIDI converter 106 for manipulation and processing via a conventional algorithm, well understood by one skilled in the art (e.g., inherent of the ABLETON® computer software program). Resultant first and second musical melodies 111, 141, having reduced latency periods, are independently and sequentially emitted from transducer 122 in a corresponding non-overlapping patterns.

Still referring to FIGS. 14-15, the music generating system 100 enables a user to generate independent and sequential musical melodies without playing an electronic percussion instrument 101. The music generating system 100 includes an electronic percussion instrument 101, and a musical instrument digital interface (MIDI) controller 102 communicatively coupled to the electronic percussion instrument 101 wherein the MIDI controller 102 is configured to receive a first user input 103 and thereby generates and transmits a corresponding first audio control signal 104. The system 100 further includes a unidirectional universal serial bus (USB) communication link coupled, via adaptor 130*a*, to the MIDI controller 102, a MIDI converter 106 communicatively coupled to the unidirectional USB communication link 130, a bidirectional USB-MIDI communication link 107 communicatively coupled, via adaptor 107*a*, to the MIDI converter 106, and a rhythm drum machine 108 in communication with the bidirectional USB-MIDI communication link 107. Such a rhythm drum machine 108 is configured to receive a second user input 131 and thereby generates and transmits a corresponding second audio control signal 110.

Advantageously, the MIDI converter 106 is configured to independently and sequentially receive and learn the first audio control signal 104 and the second audio control signal 110 in a non-overlapping pattern, and thereby independently and sequentially generates and transmits to the rhythm drum machine 108 a first musical melody 111 and a second musical melody 141 corresponding to the first audio control signal 104 and the second audio control signal 110, respectively. A transducer 122 (e.g., speaker) is communicatively coupled to the rhythm drum machine 108 in such a manner that the first musical melody 111 is audibly emitted with a reduced first latency time period, and thereafter a second musical melody 141 is audibly emitted with a reduced second latency time period. Notably, the first latency time period starts when the MIDI converter 106 learns the first audio control signal 104 and stops when the transducer 122 emits the first musical melody 111. The second latency time period starts when the MIDI converter 106 learns the second audio control signal 110 and stops when the transducer 122 emits the second musical melody 141. Advantageously, the first audio control signal 104 is non-overlapping with the second audio control signal 110, wherein each of the electronic percussion instrument 101, the MIDI controller 102, the MIDI converter 106, and the rhythm drum machine 108 is portable. Notably, the MIDI controller 102 is hand-operated and pressure sensitive to the first user input 103.

In a non-limiting exemplary embodiment, the MIDI controller 102 includes a portable first user interface 112 affixed to the electronic percussion instrument 101. Such a first user interface 112 has a first trigger pad 113 disposed directly on the electronic percussion instrument 101. In this manner, the first audio control signal 104 is generated at the first trigger pad 113 independently and sequentially of the second audio control signal 110.

In a non-limiting exemplary embodiment, the first trigger pad 113 includes a plurality of nano keys 114.

In a non-limiting exemplary embodiment, the MIDI converter 106 includes a processor 115 communicatively coupled to the first user interface 112 and the rhythm drum machine 108 for independently and sequentially receiving the first audio control signal 104 and the second audio control signal 110, respectively, in a non-overlapping pattern. Power source adapter 157 adjusts the voltage input to the MIDI converter 106. The MIDI converter 106 further includes a memory 116 communicatively coupled to the processor 115 wherein the memory 116 includes a computer software application that is executed by the processor 115 upon independently and sequentially receiving the first audio control signal 104 and the second audio control signal 110. An input/output interface 117 is communicatively coupled to the processor 115, wherein the computer software application independently and sequentially learns and converts the first audio control signal 104 and the second audio control signal 110 to independent and sequential MIDI messages, respectively, and thereby enables the MIDI controller 102 to simulate the first musical melody 111 with the first reduced latency time period and without actually playing the electronic percussion instrument 101 as well as simulate the second musical melody 141 with the second reduced latency time period without actually playing the electronic percussion instrument 101.

In a non-limiting exemplary embodiment, the rhythm drum machine 108 includes a MIDI audio signal input port 120 for receiving the second musical melody 141, a MIDI audio signal output port 121 for transmitting the second audio control signal 110, and at least one musical melody signal output port 150 for independently and sequentially emitting the first musical melody 111 and the second musical melody 141. Advantageously, the bidirectional USB-MIDI communication link 107 is contemporaneously coupled to each of the MIDI audio signal input port 120 and the MIDI audio signal output port 121 wherein the transducer 122 is communicatively coupled to the at least one musical melody signal output port 150.

In a non-limiting exemplary embodiment, the unidirectional USB communication link 130 is directly coupled to the first trigger pad 113 and the input/output interface 117 of the MIDI converter 106.

In a non-limiting exemplary embodiment, the bidirectional USB-MIDI communication link 107 is contemporaneously coupled directly to each of the input/output interface 117 of the MIDI converter 106, the MIDI audio signal input port 120, and the MIDI audio signal output port 121.

In a non-limiting exemplary embodiment, KORG® (www.korg.com) nano keys 114 may be employed with the present disclosure. For example, the MIDI controller 102 can include one or more separate nano keys 114 physically attached to the trigger pad 112 at the electronic percussion instrument 101.

In a non-limiting exemplary embodiment, BOSSUS® (www.bossus.com) DR-880 DR. RHYTHM drum machine 108 be employed as a MIDI controller 102 of the present disclosure. Thus, the rhythm drum machine 108 communicates audio signals with the MIDI converter 106 before outputting reduced latency musical melody 141 from the transducer 122.

In a non-limiting exemplary embodiment, the rhythm drum machine 108 may have a built-in MIDI converter 106 that independently reduces latency associated with audio signals generated and transmitted from the rhythm drum machine 108. Thus, the rhythm drum machine 108 may work together with MIDI converter 106 to reduce the second latency period of the second musical melody 141.

In a non-limiting exemplary embodiment, the ABLETON® (www.ableton.com) computer software program may be employed as part of the MIDI converter 106 of the present disclosure. Such a computer software program reduces the first latency period associated with the first audio control signal 104 created at the nano keys 114, and/or reduces the second latency period associated with the second audio control signal 110 created at the rhythm drum machine 108. It is noted that the rhythm drum machine 108 may employ a dedicated computer software program (as explained on www.ableton.com) that independently reduces the second latency period—independently from the ABLETON® computer software program—associated with the second audio control signal 110 and second musical melody 141. It should be noted that the ABLETON® computer software program maps the nano keys 114 to generate specific notes on the electronic percussion instrument 101 so that the user does not need to learn to play the electronic percussion instrument 101 to generate the musical melodies 111, 141.

In a non-limiting exemplary embodiment, the present disclosure relates to the field of electronic percussion instruments which target the generation of musical melodies 111, 141 through a trigger pad 113 having nano keys 114 (e.g., MIDI controller 102) in communication with a MIDI converter 106. The present disclosure facilitates the generation of musical melodies 111, 141 by employing one or more trigger pads 113 (e.g., MIDI controller 102), a rhythm drum machine 108, and a computer software program (e.g., MIDI converter 106) that minimizing the latency periods in the generated musical melodies 111, 141.

In a non-limiting exemplary embodiment, trigger pad 113 has nano keys 114 that can be affixed to a variety of surfaces such as an electronic percussion instrument 101, table top, etc. The trigger pad 113 may have a flexible rubber substrate deformable to a desired shape. Additionally, the trigger pad 113 may have a predetermined shape similar to a hand, for example. As noted above, a first user input 103 is applied at the trigger pad 113 when struck with a user finger, stick or any other similar instrument capable of actuating the nano keys 114.

In a non-limiting exemplary embodiment, the reduced latency musical melodies 111, 141 are generated as an effect of the synthesis that is driven by the inter-relationship between the MIDI controller 102 (e.g., nano keys 114), the USB unidirectional communication link 130, the MIDI converter 106 (e.g., computer software program), the bidirectional USB-MIDI communication link 107, the rhythm drum machine 108, and the powered transducer 122. Advantages of the current disclosure allow the user to have the flexibility of generating reduced latency musical melodies 111, 141 via communication between the MIDI converter 106 and MIDI controller 102 whereby the nano keys 114 are mapped to a desired note that the user wants to simulate without actually playing the electronic percussion instrument 101.

In a non-limiting exemplary embodiment, the nano keys 114 of the trigger pad(s) 113 are arranged as such to be distinct and have minimum distances between them without overlapping. Each nano key 114 can be programmed to generate multiple notes via the MIDI converter 106 (e.g., graphical user interface on a computer display screen). The nano keys 114 arrangement is such that a multitude of notes can be synthesized using even one user finger.

In a non-limiting exemplary embodiment, the rhythm drum machine 108 may employ a built-in MIDI converter 106 that maps each second audio control signal 110 with an associated reduced latency musical melody 141.

In a non-limiting exemplary embodiment, the present disclosure utilizes electronic devices (e.g., MIDI controller 102, MIDI converter 106) to provide user customizable controls. For example, a first user input 103 is applied at the nano keys 114 when stuck with fingers, stick or any other similar instrument. Such a first user input 103 at the nano keys 114 is directed towards the MIDI converter 106 where it is processed by the ABLETON® computer software program to minimize the first latency period associated therewith. This processed signal then passes through the rhythm drum machine 108 where it emanates from the powered speakers (e.g., transducer 122) as a reduced latency musical melody 111.

In a non-limiting exemplary embodiment, the rhythm drum machine 108 may contain a built-in MIDI converter 106 that reduces latency period of the second audio control signal 110. Thus, a second musical melody 141 is emanated from the powered speakers 122 independent and sequentially of the first musical melody 111, and in a non-overlapping pattern.

It should also be noted the software that implements the disclosed methods may optionally be stored on a tangible storage medium, such as a magnetic medium, such as a disk or tape; a magneto-optical or optical medium, such as a disk; or a solid state medium, such as a memory card or other package that houses one or more read-only (non-volatile) memories, random access memories, or other re-writable (volatile) memories. The software may also utilize a non-transitive signal containing computer instructions. A digital file attachment to e-mail or other self-contained information archive or set of archives is considered a distribution medium equivalent to a tangible storage medium. Accordingly, the disclosure is considered to include a tangible storage medium or distribution medium as listed herein, and other equivalents and successor media, in which the software implementations herein may be stored.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A music generating system for enabling a user to generate a musical melody without playing an electronic percussion instrument, said music generating system comprising:

an electronic percussion instrument;

a musical instrument digital interface(MIDI) controller communicatively coupled to said electronic percussion instrument, said MIDI controller configured to receive a first user input and thereby generates and transmits a corresponding first audio control signal;

a unidirectional universal serial bus (USB) communication link coupled to said MIDI controller;

a MIDI converter communicatively coupled to said unidirectional USB communication link;

a bidirectional USB-MIDI communication link communicatively coupled to said MIDI converter;

a rhythm drum machine in communication with said bidirectional USB-MIDI communication link, said rhythm drum machine being configured to receive a second user input and thereby generates and transmits a corresponding second audio control signal;

wherein said MIDI converter is configured to independently and sequentially receive and learn said first audio control signal and said second audio control signal in a non-overlapping pattern and thereby independently and sequentially generates and transmits to said rhythm drum machine a first musical melody and a second musical melody corresponding to said first audio control signal and said second audio control signal, respectively; and a transducer communicatively coupled to said rhythm drum machine in such a manner that said first musical melody is audibly emitted with a reduced first latency time period, and thereafter a second musical melody is audibly emitted with a reduced second latency time period;

wherein said first latency time period starts when said MIDI converter learns said first audio control signal and stops when said transducer emits said first musical melody;

wherein said second latency time period starts when said MIDI converter learns said second audio control signal and stops when said transducer emits said second musical melody;

wherein said first audio control signal is non-overlapping with said second audio control signal.

2. The music generating system of claim 1, wherein said MIDI controller comprises: a portable first user interface affixed to said electronic percussion instrument, said first user interface having a first trigger pad disposed directly on said electronic percussion instrument, wherein said first audio control signal is generated at said first trigger pad independently and sequentially of said second audio control signal.

3. The music generating system of claim 2, wherein said first trigger pad comprises: a plurality of nano keys.

4. The music generating system of claim 3, wherein said MIDI converter comprises:

a processor communicatively coupled to said first user interface and said rhythm drum machine for independently and sequentially receiving said first audio control signal and said second audio control signal, respectively, in a non-overlapping pattern; and a memory communicatively coupled to said processor, said memory including a computer software application that is executed by said processor upon independently and sequentially receiving said first audio control signal and said second audio control signal; and an input/output interface communicatively coupled to said processor;

wherein said computer software application independently and sequentially learns and converts said first audio control signal and said second audio control signal to independent and sequential MIDI messages and thereby enables said MIDI controller to simulate said first musical melody with said first reduced latency time period and without actually playing the electronic percussion instrument as well as simulate said second musical melody with said second reduced latency time period.

5. The music generating system of claim 4, wherein said rhythm drum machine comprises:

a MIDI audio signal input port for receiving said second musical melody;

a MIDI audio signal output port for transmitting said second audio control signal; and at least one musical melody signal output port for independently and sequentially emitting said first musical melody and said second musical melody;

wherein said bidirectional USB-MIDI communication link is contemporaneously coupled to each of said MIDI audio signal input port and said MIDI audio signal output port;

wherein said transducer is communicatively coupled to said at least one musical melody signal output port.

6. The music generating system of claim 5, wherein said unidirectional USB communication link is directly coupled to said first trigger pad and said input/output interface of said MIDI converter.

7. The music generating system of claim 6, wherein said bidirectional USB-MIDI communication link is contemporaneously coupled directly to each of said input/output interface of said MIDI converter, said MIDI audio signal input port, and said MIDI audio signal output port.

8. A music generating system for enabling a user to generate a musical melody without playing an electronic percussion instrument, said music generating system comprising:

an electronic percussion instrument;

a musical instrument digital interface(MIDI) controller communicatively coupled to said electronic percussion instrument, said MIDI controller configured to receive a first user input and thereby generates and transmits a corresponding first audio control signal;

a unidirectional universal serial bus (USB) communication link coupled to said MIDI controller;

a MIDI converter communicatively coupled to said unidirectional USB communication link;

a bidirectional USB-MIDI communication link communicatively coupled to said MIDI converter;

a rhythm drum machine in communication with said bidirectional USB-MIDI communication link, said rhythm drum machine being configured to receive a second user input and thereby generates and transmits a corresponding second audio control signal;

wherein said MIDI converter is configured to independently and sequentially receive and learn said first audio control signal and said second audio control signal in a non-overlapping pattern and thereby independently and sequentially generates and transmits to said rhythm drum machine a first musical melody and a second musical melody corresponding to said first audio control signal and said second audio control signal, respectively; and a transducer communicatively coupled to said rhythm drum machine in such a manner that said first musical melody is audibly emitted with a reduced first latency time period, and thereafter a second musical melody is audibly emitted with a reduced second latency time period;

wherein said first latency time period starts when said MIDI converter learns said first audio control signal and stops when said transducer emits said first musical melody;

wherein said second latency time period starts when said MIDI converter learns said second audio control signal and stops when said transducer emits said second musical melody;

wherein said first audio control signal is non-overlapping with said second audio control signal;

wherein each of said electronic percussion instrument, said MIDI controller, said MIDI converter, and said rhythm drum machine is portable;

wherein said MIDI controller is hand-operated and pressure sensitive to said first user input.

9. The music generating system of claim 8, wherein said MIDI controller comprises: a portable first user interface affixed to said electronic percussion instrument, said first user interface having a first trigger pad disposed directly on said electronic percussion instrument, wherein said first audio control signal is generated at said first trigger pad independently and sequentially of said second audio control signal.

10. The music generating system of claim 9, wherein said first trigger pad comprises: a plurality of nano keys.

11. The music generating system of claim 10, wherein said MIDI converter comprises:

a processor communicatively coupled to said first user interface and said rhythm drum machine for independently and sequentially receiving said first audio control signal and said second audio control signal, respectively, in a non-overlapping pattern; and a memory communicatively coupled to said processor, said memory including a computer software application that is executed by said processor upon independently and sequentially receiving said first audio control signal and said second audio control signal; and an input/output interface communicatively coupled to said processor;

wherein said computer software application independently and sequentially learns and converts said first audio control signal and said second audio control signal to independent and sequential MIDI messages and thereby enables said MIDI controller to simulate said first musical melody with said first reduced latency time period and without actually playing the electronic percussion instrument as well as simulate said second musical melody with said second reduced latency time period.

12. The music generating system of claim 11, wherein said rhythm drum machine comprises:

a MIDI audio signal input port for receiving said second musical melody;

a MIDI audio signal output port for transmitting said second audio control signal; and at least one musical melody signal output port for independently and sequentially emitting said first musical melody and said second musical melody;

wherein said bidirectional USB-MIDI communication link is contemporaneously coupled to each of said MIDI audio signal input port and said MIDI audio signal output port;

wherein said transducer is communicatively coupled to said at least one musical melody signal output port.

13. The music generating system of claim 12, wherein said unidirectional USB communication link is directly coupled to said first trigger pad and said input/output interface of said MIDI converter.

14. The music generating system of claim 13, wherein said bidirectional USB-MIDI communication link is contemporaneously coupled directly to each of said input/output interface of said MIDI converter, said MIDI audio signal input port, and said MIDI audio signal output port.

* * * * *